US007665611B2

(12) United States Patent
Koch

(10) Patent No.: US 7,665,611 B2
(45) Date of Patent: Feb. 23, 2010

(54) BOTTLE COMPRISING A TEMPORAL INDICATOR

(76) Inventor: Mark Koch, 223 W. 29th St., New York, NY (US) 10001

( * ) Notice: Subject to any disclaimer, the term of this patent is extended or adjusted under 35 U.S.C. 154(b) by 256 days.

(21) Appl. No.: 11/478,458

(22) Filed: Jun. 28, 2006

(65) Prior Publication Data

US 2008/0000792 A1 Jan. 3, 2008

(51) Int. Cl.
*B65D 83/04* (2006.01)
*B65D 85/00* (2006.01)

(52) U.S. Cl. ..... 206/534; 206/459.1; 206/528; 215/230

(58) Field of Classification Search ..... 206/534, 206/540, 459.5, 828, 459.1, 528; 215/365, 215/230, 366, 206, 215, 217, 220, 222; 116/308
See application file for complete search history.

(56) References Cited

U.S. PATENT DOCUMENTS 2,706,464 A * 4/1955 North ..... 116/308
3,656,646 A * 4/1972 Taylor ..... 215/206
3,678,884 A * 7/1972 Robbins ..... 116/308
3,843,007 A * 10/1974 Meyer ..... 215/206
4,405,045 A * 9/1983 Villa-Real ..... 206/534
4,802,438 A 2/1989 DeJonge
4,913,083 A * 4/1990 Valvo et al. ..... 116/308
5,297,687 A * 3/1994 Freed ..... 215/206
5,356,012 A * 10/1994 Tang et al. ..... 206/534
5,482,163 A * 1/1996 Hoffman ..... 206/534
5,662,224 A * 9/1997 Nogues ..... 206/534
5,732,836 A 3/1998 Barker et al.
5,850,919 A * 12/1998 Freed ..... 206/534
6,068,149 A * 5/2000 Telega ..... 215/230
6,089,180 A * 7/2000 Nichols, Jr. ..... 116/309

OTHER PUBLICATIONS

International Search Report.

* cited by examiner

*Primary Examiner*—Mickey Yu
*Assistant Examiner*—Steven A. Reynolds
(74) *Attorney, Agent, or Firm*—F. Chau & Associates, LLC

(57) ABSTRACT

A bottle includes an indictor and a listing of times and/or days for administering pills. The indicator may be disposed on a cap or on the bottle. The strip is disposed opposite the indicator; on the bottle or the cap, respectively. The indicator and strip indicate a next prescribed time to take a pill or the last time a pill was taken.

12 Claims, 3 Drawing Sheets

BOTTLE COMPRISING A TEMPORAL INDICATOR

BACKGROUND OF THE INVENTION

1. Field of the Invention

The present invention relates to a container, and more particularly to a bottle indicating a date or time period.

2. Discussion of Related Art

Containers for planning or tracking a persons' use of medication or vitamins include elongated containers having separate compartments for each day of the week. These containers can be cumbersome to fill and require that different pills be allocated to different compartments correctly. These steps are a factor in non-compliance with doctor's orders or manufacture's suggested daily requirements.

Therefore, a need exists for a bottle indicating a date or time period.

SUMMARY OF THE INVENTION

According to an embodiment of the present disclosure, a bottle system comprises an indictor disposed on one of the bottle or a cap, and a listing indicating times and/or days for administering contents of the bottle, the listing being disposed on one of the bottle or the cap, opposite the indictor.

The bottle system further comprises a ring coupled to the cap, the ring comprising a notch for receiving the indicator. The ring rotates on the cap. The ring substantially prevents the cap from being removed from the bottle when the notch is misaligned with the indicator.

The bottle and the cap each comprise tabs, which cooperate to lock the cap to the bottle, wherein a diaphragm coupled to the cap applies a force against the bottle to secure the tabs in a locked position.

The indicator and listing indicate a next prescribed time to administer the contents or the last time the contents where administered.

BRIEF DESCRIPTION OF THE FIGURES

Preferred embodiments of the present invention will be described below in more detail, with reference to the accompanying drawings.

DETAILED DESCRIPTION OF PREFERRED EMBODIMENTS

Figure 1A:
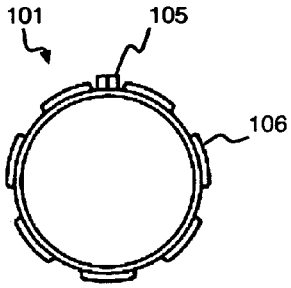
FIGS. 1A-C are top views of a bottle, cap, and ring, respectively, according to an embodiment of the present disclosure.
Figure 1B:
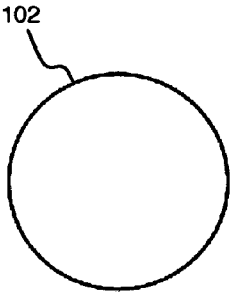
Figure 1C:
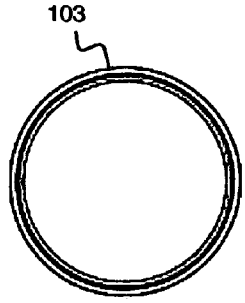

Referring to FIGS. 1A-C, 2A-C and 3, according to an embodiment of the present disclosure, a bottle 101 cooperates with a lid 102 and ring 103. The lid 102 includes a listing of times and/or days for administering medication, vitamins, and the like. The ring 103 includes a notch 104, which cooperates with an indicator 105 disposed on the bottle 101.

Figure 2A:
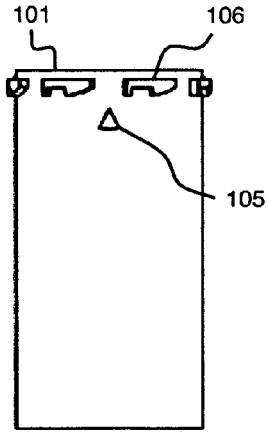
FIGS. 2A-D are side views of a bottle, cap, and ring, respectively, according to an embodiment of the present disclosure.
Figure 2B:
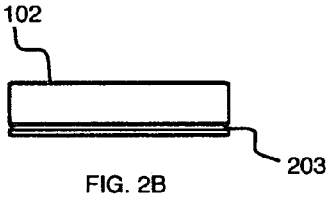
Figure 2C:
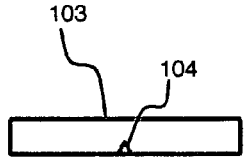
Figure 2D:
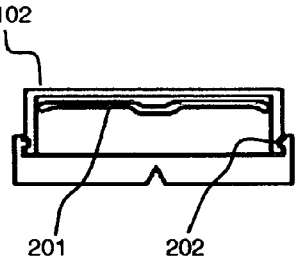
Figure 3:
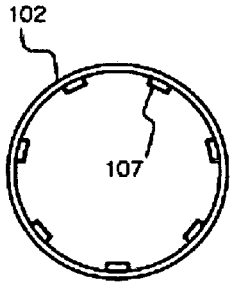
FIG. 3 is a bottom view of a cap, according to an embodiment of the present disclosure.
Figure 4B:
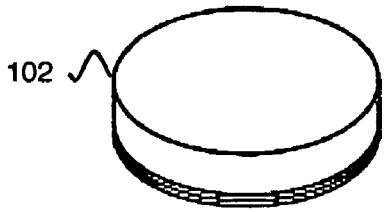
FIGS. 4A-C are perspective views of a bottle, cap, and ring, respectively, according to an embodiment of the present disclosure.
Figure 4C:
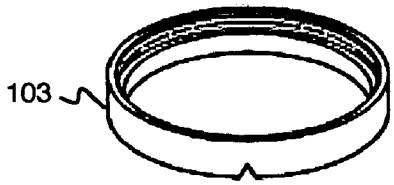
Figure 4A:
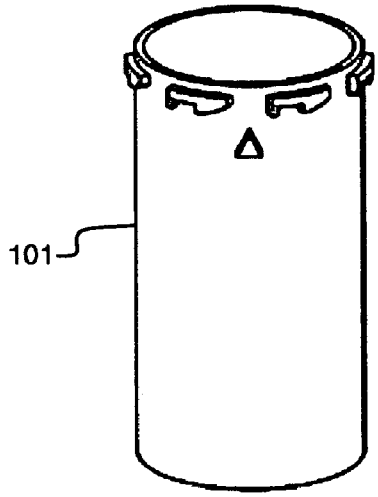
Figure 5:
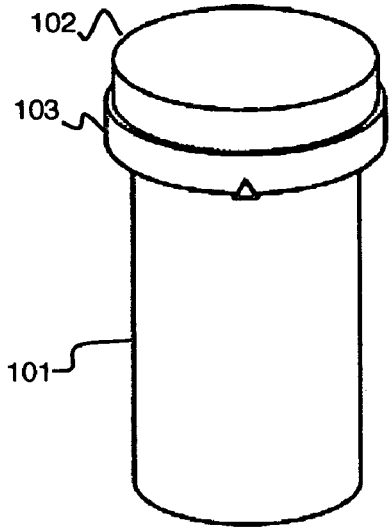
FIG. 5 is a perspective view of an assembled bottle, cap, and ring, respectively, according to an embodiment of the present disclosure.

Referring to FIGS. 1A, 2A, and 3, the bottle 101 and the cap 102 comprise a locking mechanism for securing the cap to the bottle. The locking mechanism comprises cooperating tabs 106/107. Referring to FIG. 2D, the lock mechanism further comprises a diaphragm 201 disposed inside the cap for applying a force against an upper part of the bottle in a closed position. The diaphragm 201 pushes the bottle 101 away from the cap 102 and thus engages the cooperating tabs 106/107 when the cap 102 is appropriately arranged.

Figure 6A:
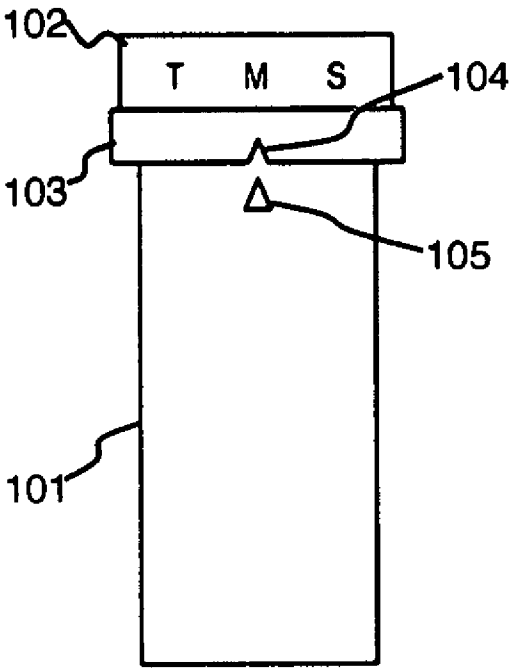
FIGS. 6A-D illustrate opening and closing a bottle, according to an embodiment of the present disclosure.
Figure 6B:
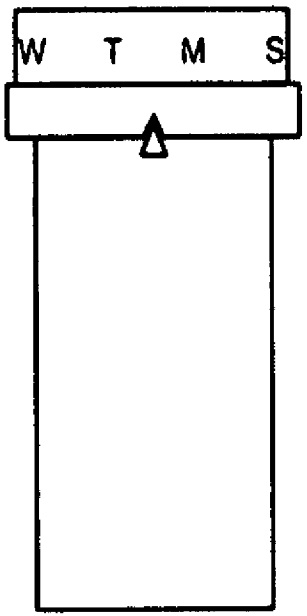
Figure 6C:
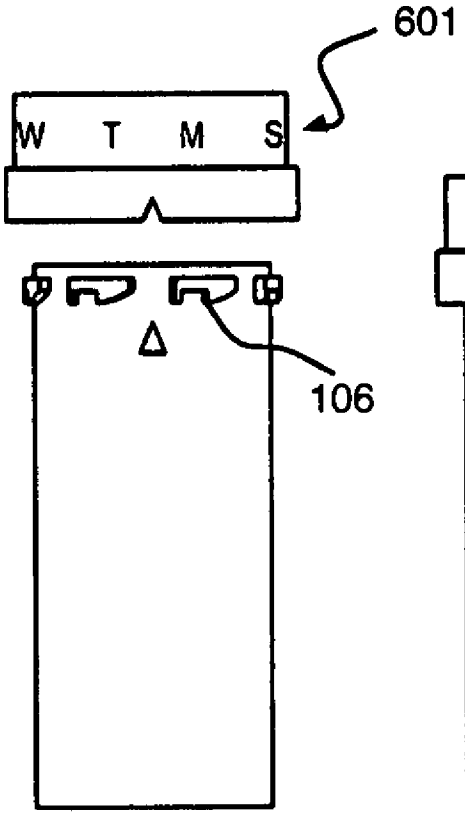
Figure 6D:
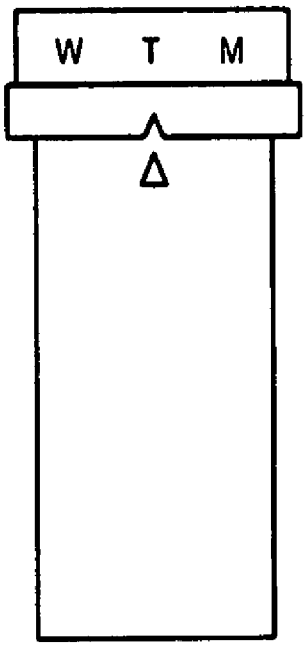

The number of tabs 106/107 and the position of the tabs 106/107 are arranged such that the listing, e.g., a day-of-the-week indication, is aligned with the indicator 105 when the cap is in a locked position (see for example, FIGS. 6A-1D).

Referring to FIG. 3, an exemplary embodiment of the locking mechanism includes substantially square tabs 107 disposed on one of the bottle or the cap. The locking mechanism further includes a shaped tab 106 (see FIG. 2A), adapted to receive and secure the square tabs 107. An opposing force is maintained between the cap 102 and bottle 101, for example, by a diaphragm disposed in the cap, wherein the bottle deflects the diaphragm such that the diaphragm generates the opposing force. One of ordinary skill in the art would appreciate that other locking mechanisms may be used.

Optionally, a ring 103 is disposed under the cap 102. The ring 103 rotates on to the cap 102 and engages into the indicator 105 when aligned with the notch 104 and depressed. Referring to FIG. 2D, the ring 103 includes a rib 202 cooperating with a grove 203 (see FIG. 2B) in the cap 102 to secure the ring 103 to the cap 102. The ring 103 is disposed having a friction fit, wherein rotation of the ring 103 is substantially prevented from freely rotating. When the cap 102 is rotated, the notch 104 and the indicator 105 stay engaged. This substantially prevents a user from putting the cap 102 back in the wrong position.

FIGS. 6A-D show a sequence of opening a bottle 101. Note that if the ring 103 is turned out of alignment with the indictor 105 on the bottle 101, the indicator 105 cannot engage in the notch 104, and the cap 102 cannot be depressed to disengage the tabs 106/107 and open the bottle 101. Accordingly, the ring 103 may be implemented as a further locking mechanism, substantially preventing opening of the bottle 101, by disposing the notch 104 in a misaligned position with respect to the indicator 105.

In the exemplary embodiment shown in FIGS. 1A and 3, seven tabs 106/107 are disposed on each of the bottle 101 and cap 102. This is an example of a bottle used where a dose is needed once per day.

The indicator 105 and listing (e.g., see FIG. 6C, 601) may be disposed on the cap 102 or on the bottle 101. Where the listing 601 is disposed on the bottle, the listing 601 may rotated on the bottle 101 each time a cap 102 is depressed and turned in a direction to open the bottle 101. The listing 601 rotates one increment each time the bottle 101 is opened.

Figure 7:
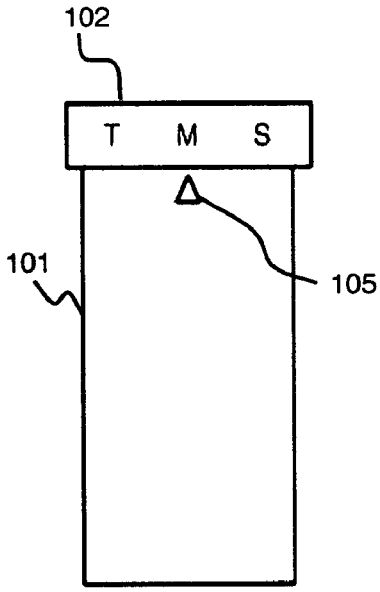
FIG. 7 is a diagram of a cap and bottle according to an embodiment of the present disclosure.

Referring to FIG. 7, according to an embodiment of the present disclosure, a system may include a bottle 101, a cap 102, and an indicator 105, without implementing a ring. The indicator 105 may be disposed on the bottle 101 or cap 102, and be disposed opposed a listing, for example, of dates and/or times. Further the indicator 105 may be provided in relief or as a graphic.

Having described embodiments for a bottle indicating a date or time period, it is noted that modifications and variations can be made by persons skilled in the art in light of the above teachings. It is therefore to be understood that changes may be made in the particular embodiments of the invention disclosed which are within the scope and spirit of the invention as defined by the disclosure.

What is claimed is:

1. A bottle system comprising:

an indicator disposed on the bottle;

a listing indicating temporal information for administering contents of the bottle, the listing being disposed on the cap; and a ring rotatably coupled directly to the cap, wherein the cap and ring are a unit removable from the bottle, and wherein the ring comprises a notch formed across a portion of a bottom surface for receiving the indicator upon application of a force depressing the cap towards the bottle, wherein the bottle and the cap each comprise tabs, which cooperate to lock the cap to the bottle, wherein a depressible diaphragm coupled to the cap applies a force against the bottle to secure the tabs in a locked position and secure the ring at a position wherein the notch is disengaged from the indicator disposed on the bottle, wherein the tabs of the bottle are disposed on a surface of the bottle in a plane between the indicator and an opening of the bottle.

2. The bottle system of claim 1, wherein the ring substantially prevents the cap from being removed from the bottle when the notch is misaligned with the indicator.

3. The bottle system of claim 1, wherein the indicator and listing indicate a next prescribed time to administer the contents or the last time the contents where administered.

4. The bottle system of claim 1, wherein the ring rotates on the cap independently of the bottle.

5. The bottle system of claim 1, wherein the ring is coupled to an outside surface of the cap and fits over the bottle.

6. The bottle system of claim 1, wherein the ring exposes the indicator disposed on the bottle.

7. A bottle system comprising:

an indicator disposed on a surface of the bottle;

a listing of symbols disposed on the cap; and a ring coupled to the cap, the ring comprising a notch for receiving the indicator, wherein the ring rotates on the cap, and wherein the ring substantially prevents the cap from being removed from the bottle when the notch is misaligned with the indicator, wherein the bottle and the cap each comprise tabs, which cooperate to lock the cap to the bottle, wherein a depressible diaphragm coupled to the cap applies a force against the bottle to secure the tabs in a locked position and secure the ring at a position wherein the notch is disengaged from the indicator disposed on the bottle, wherein the tabs of the bottle are disposed on the surface of the bottle relatively near an opening of the bottle as compared to the indicator.

8. The bottle system of claim 7, wherein the indicator and listing indicate a next prescribed time to administer contents or a last time the contents where administered.

9. The bottle system of claim 7, wherein the ring rotates on the cap independently of the bottle.

10. The bottle system of claim 7, wherein the ring is coupled to an outside surface of the cap and fits over the bottle.

11. The bottle system of claim 7, wherein the ring exposes the indicator disposed on the bottle.

12. A bottle system comprising:

a cap comprising a listing of a plurality of temporal indications disposed on the cap for administering contents of the bottle;

an indicator disposed on a surface of the bottle below the cap when the cap is coupled to the bottle, wherein the indicator is disposed to be aligned to a first temporal indication of the plurality of temporal indications; and a ring rotatably coupled to the cap, the ring comprising a notch for receiving the indicator, wherein the ring substantially prevents the cap from being removed from the bottle when the notch is misaligned with the indicator, and wherein the ring remains stationary relative to the bottle when the cap is depressed to engage the indicator with the notch and rotated, the rotation of the cap positioning the ring for indicating a next temporal indication different than the first temporal indication upon a next coupling of the cap and the bottle.

* * * * *